US006318932B1

(12) United States Patent
Tyler

(10) Patent No.: US 6,318,932 B1
(45) Date of Patent: Nov. 20, 2001

(54) SEASONAL DOCK WITH SELF-STOWING LIFTING DEVICE

(76) Inventor: Dennis Tyler, P.O. Box 84, Sanbornville, NH (US) 03872

( * ) Notice: Subject to any disclaimer, the term of this patent is extended or adjusted under 35 U.S.C. 154(b) by 0 days.

(21) Appl. No.: 09/799,971

(22) Filed: Mar. 5, 2001

(51) Int. Cl.[7] ..... E02B 3/20
(52) U.S. Cl. ..... 405/218; 405/220
(58) Field of Search ..... 405/218, 219, 405/220, 221

(56) References Cited

U.S. PATENT DOCUMENTS

| | | | | |
|---|---|---|---|---|
| 2,948,121 | * | 8/1960 | Karst | 405/220 |
| 3,686,876 | * | 8/1972 | Muschell | 405/220 |
| 3,747,354 | | 7/1973 | Macomber . | |
| 3,841,104 | * | 10/1974 | Hufford | 405/220 |
| 4,287,625 | | 9/1981 | Dawson . | |
| 4,398,849 | * | 8/1983 | Moran et al. | 405/218 |
| 4,505,619 | * | 3/1985 | Sargent | 405/220 |
| 4,645,380 | * | 2/1987 | Hambrick et al. | 405/220 |
| 4,804,298 | * | 2/1989 | Nasby, Jr. | 405/218 |
| 5,044,829 | * | 9/1991 | Hemminger | 405/220 |
| 5,165,823 | | 11/1992 | Cupples . | |
| 5,400,733 | | 3/1995 | Richter . | |
| 5,588,782 | | 12/1996 | Haring . | |

* cited by examiner

*Primary Examiner*—David Bagnell
*Assistant Examiner*—Frederick L. Lagman
(74) *Attorney, Agent, or Firm*—Phillip E. Decker

(57) ABSTRACT

A seasonal dock having a self-stowing lifting device having a mounting structure, a tower structure, and a platform structure, where the tower structure and platform structure are hinged to the mounting structure, and the tower structure stows inside the platform structure when not in use. The tower structure is about 80% of the length of the platform structure. In operation, cables are attached from the platform structure to the tower structure such that they are at about 45 degrees to each other, and another cable is attached from the tower structure to a winch.

19 Claims, 4 Drawing Sheets

SEASONAL DOCK WITH SELF-STOWING LIFTING DEVICE

BACKGROUND

1. Field of the Invention.

The invention relates to boat docks that are capable of being taken out of the water for off-season storage.

2. Description of the Related Art.

In many parts of the world, boating is a seasonal activity. Winter storms and freezing waters make it desirable to take boat docks out of the water to prevent damage. However, because of their shape and weight, docks are difficult to handle.

Some dock owners have floating docks. These docks must be dragged onto shore for storage, where they take up valuable yard space. Docks that do not float must typically be lifted out of the water for storage. With non-floating docks, the owner must get into the cold water every autumn to disassemble the dock by hand and haul it onto shore.

Also in the prior art, docks that are hinged at the shore end could be hoisted out of the water, but owners have had to locate their docks near a standing structure, like a tree. The owner passes a cable over a pulley attached to a tree, and attaches the end of the cable to the end of the dock. With the other end of the cable, the owner hoists the dock out of the water. The shortcoming of this procedure is that one can only place a dock near trees or other structures on shore.

If a dock was provided with a pole or other lifting structure to help lift the dock, the pole would have to be stored somewhere near the dock. It would take up valuable shoreline space if stored nearby. What is needed, therefore, is a seasonal dock that can be hoisted out of the water without the need to get wet, and having a lifting device that can be stowed within the dock itself.

SUMMARY

The present invention is directed to satisfying the need for a seasonal dock that can be hoisted out of the water with a self-stowing lifting device. A dock having the features of the present invention comprises a mounting structure secured to land near a shoreline, a tower structure hingedly secured to the mounting structure, a platform structure hingedly secured to the mounting structure, and the platform structure having a recess capable of receiving substantially all of the tower structure. These and other features, aspects, and advantages of the present invention will become better understood with regard to the following description and accompanying drawings.

DRAWINGS

DESCRIPTION

Figure 1:
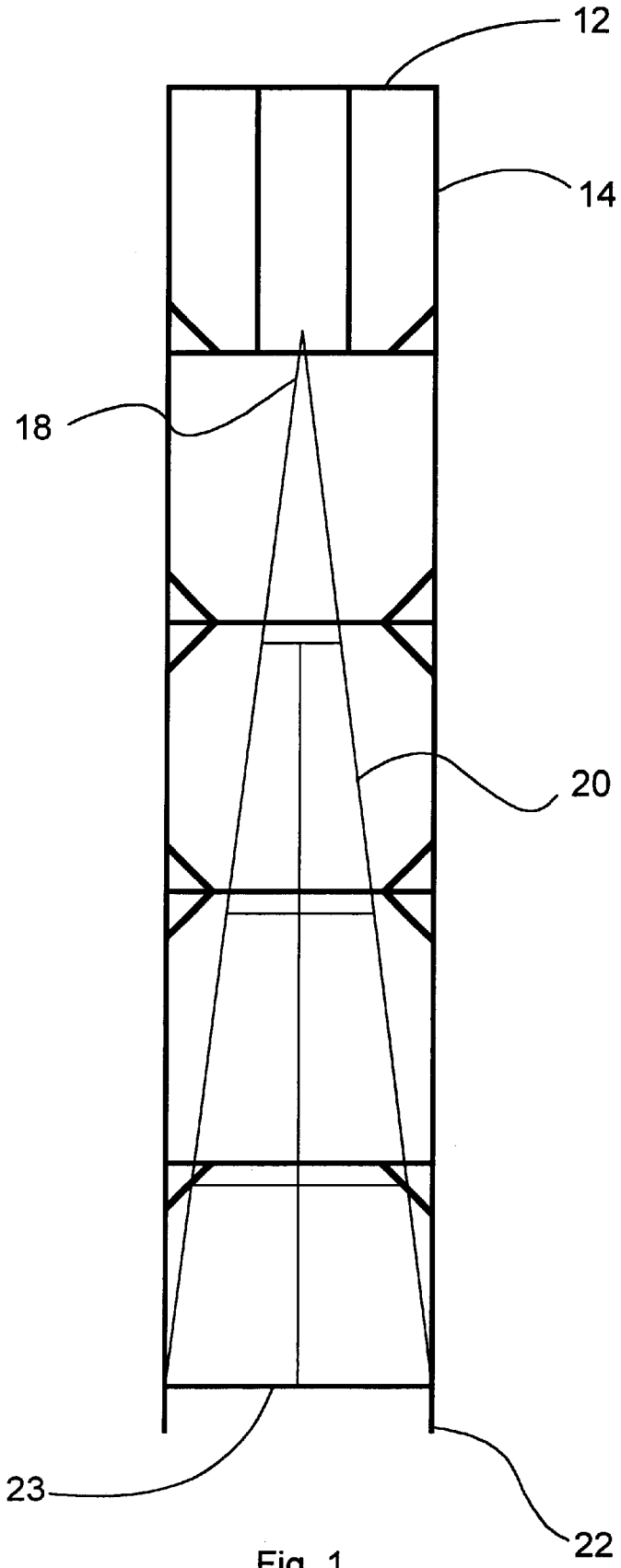
FIG. 1 is a top view of a tower structure assembled to an upper platform structure.
Figure 2:
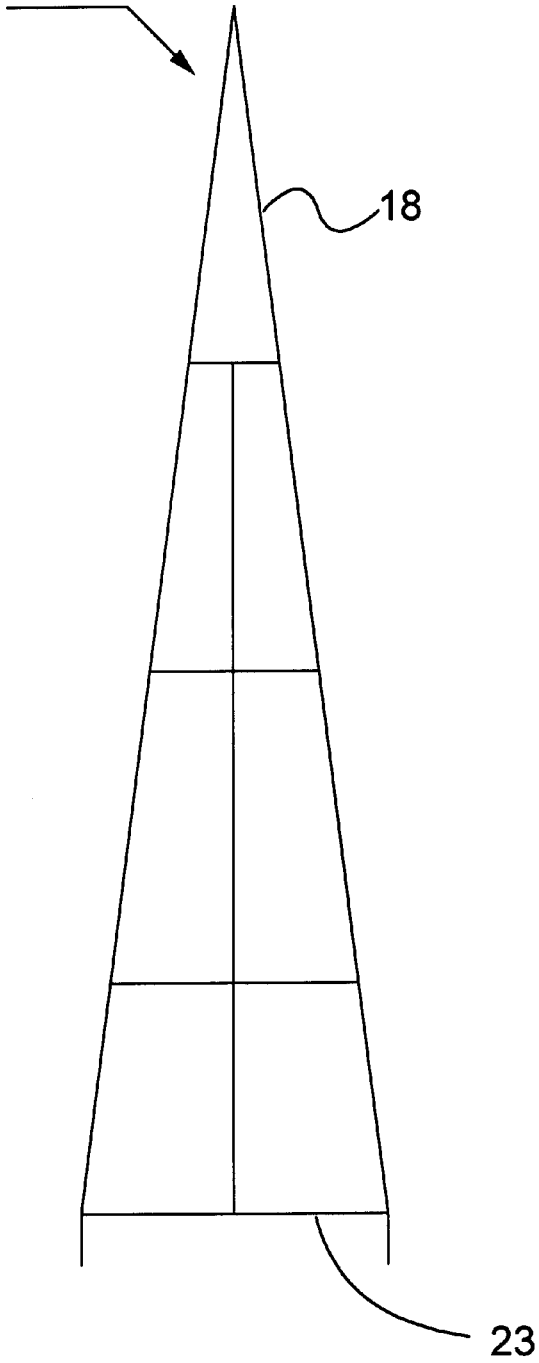
FIG. 2 shows the details of a tower structure according to the preferred embodiment.

Turning to FIGS. 1 and 2, the dock assembly of the present invention is made of several components. Looking down at the assembly as in the figures, a tower structure 20 when being stored lies in a recess in the upper platform structure 14 suitably adapted to receive substantially all of the tower structure 20. Details of the upper platform bracing are shown as examples of the preferred embodiment. The tower 20 has a shore end 23 that is nearest the shore when in use. The tower also has a lake end 18 that is furthest away from the shore when in use. Likewise, the upper platform 14 has a shore end 22 and a lake end 12.

The structural members forming the outside perimeter of the upper platform 14 are preferably about as thick as the structural members of the tower 20. Much of the bracing attached to the upper platform is attached underneath the perimeter members. The perimeter members and the bracing in this manner form the recess that is capable of receiving and storing the tower 20.

The tower 20 is shown to be about 80% of the length of the upper platform 14. One reason for this ratio is that it is desirable to completely enclose the tower 20 from view when not in use for better aesthetic qualities. This configuration also provides structural support for decking. It would be undesirable to extend the tower lake end 18 past the lake end 12 of the upper platform 14 because it could interfere with boat handling and safety. Therefore, the length of the tower should be less than 100% of the length of the upper platform.

The tower 20 must be long enough, however, to provide sufficient mechanical advantage for lifting the dock out of the water. The preferred embodiment shown in FIG. 1 describe an upper platform structure 14 than can be manufactured in five segments. It has been shown that the tower is long enough to provide sufficient mechanical advantage if its length extends over four of the five segments, or about 80%, so that a cable attached near the lake end 18 of the tower 20 can also be attached near the end of the fourth segment of a five segment platform. It is conceivable that a tower could be constructed that provides sufficient mechanical advantage even if it passes over only the third segment, giving a length of about 60% of the upper platform. Note, however, these percentages are not exact. The shore end 23 of the tower structure 20 need not be exactly co-linear or coaxial with the shore end 22 of the upper platform structure 14. The shore ends could be staggered if desired.

FIG. 2 shows details of the tower structure 20. In the preferred embodiment, the tower structure is an A-frame. The A-frame is most suitable because it is light and rigid. It is shown with bracketing, but can be provided with other bracketing or no brackets at all. The tower structure 20 could be a pole, a rectangular structure, a trapezoidal structure, or any other structure capable of withstanding the forces of lifting a dock and being stored within the platform.

Figure 3:
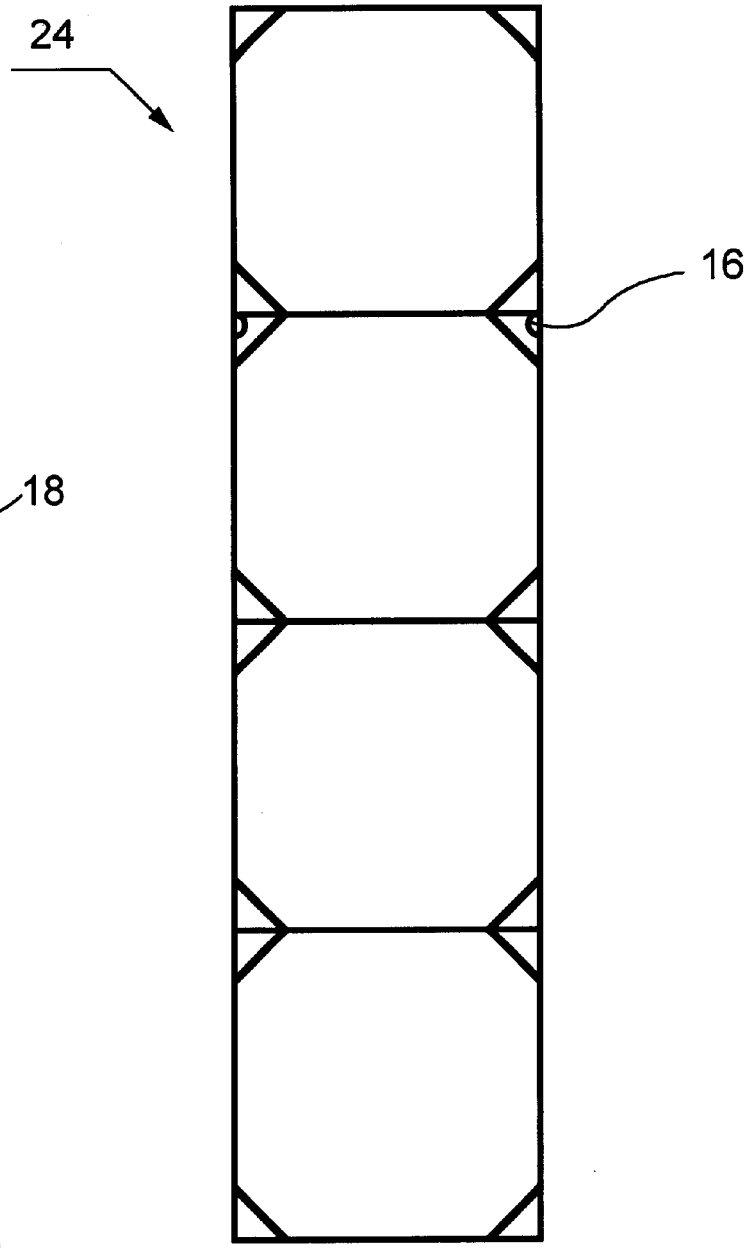
FIG. 3 is a top view of a lower platform structure.

FIG. 3 provided details of a platform lower structure 24. The preferred embodiment as shown is shorter than the upper platform 14, although it could be the same or different lengths. The tower structure 20, upper platform 14, and lower platform 24 are preferably made from welded type 6063 aluminum box tubing, although other materials may be used.

To the lower platform 24 are attached lifting eyes 16 secured to the lower platform 24 for attaching one end of a cable or rope, not shown. The other end of the cable is attached near the lake end 18 of the tower structure 20 shown in FIG. 1. It is important that the lake end 18 of the tower 20 be near the eyes 16 for providing maximum mechanical advantage when hoisting the dock out of the water. It is not necessary that two eyes are provided, as long as at least one point of attachment is provided. Instead of lifting eyes as such, a hole or holes in the lower platform structure could be provided to perform the same function in the same way. Nor is it necessary that the lifting eyes be provided where shown, although it will be realized that this configuration provides the maximum mechanical advantage when in operation.

Figure 4:
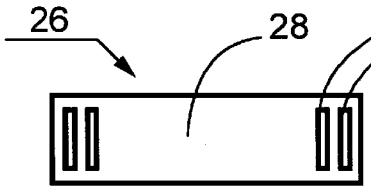
FIG. 4 is a top view of a mounting structure.
Figure 5:
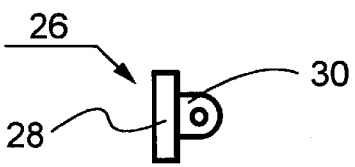
FIG. 5 is a side view of the mounting structure of FIG. 4.

FIGS. 4 and 5 show the top view and side view respectively of the preferred embodiment mounting structure 26, comprising a mounting plate 28 and two or four ears 30. The mounting plate 28 preferably is made of a half inch thick by six inches wide by the width of the dock plate material. The ears 30 are preferably a half inch by four inches wide by five inches high, and rounded. The ears 30 are preferably attached substantially perpendicular to the mounting plate 28 and are aligned and spaced to form a hinge structure with the tower structure 20 and upper platform structure 14. The ears 30 preferably have about one inch diameter holes made about one and a half inches from the top of the ear to the center of the hole. It is understood that hinge structures are not a required feature of the invention, since it is known by persons having skill in the art that other structures and elements are capable of pivoting the end of the upper platform and tower.

Figure 6:
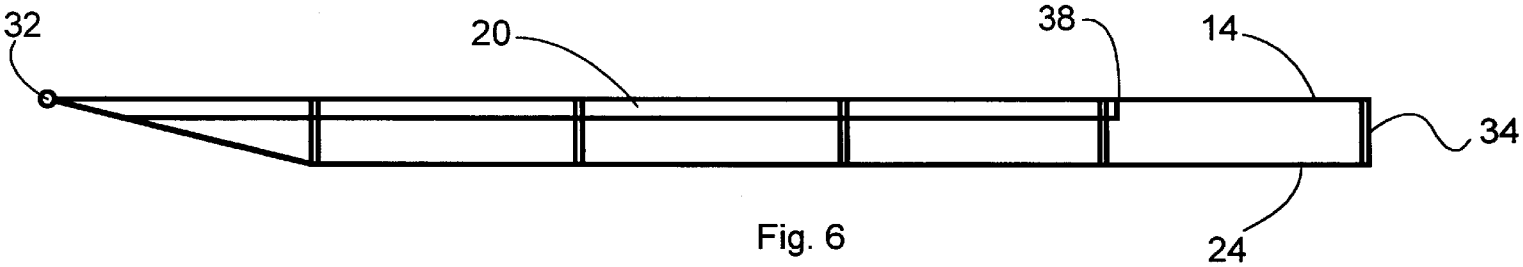
FIG. 6 is a side view of the upper and lower platform structure and tower structure assembled.

FIG. 6 is a side view of the upper platform structure 14 and lower platform structure 24 and tower structure 20 assembled. Since the lower platform 24 is shorter than the upper platform 14, additional members should be provided to connect them at their shore ends as shown as the angled members. In this way, the upper platform is more nearly co-planer with the shore surface, which makes walking easier, and at the same the lower platform 24 clears the shore. The hinge means 32 can be any structure, such as a hinge, that will cause the dock to pivot.

Sets of double supports 34 are preferably provided where each of the sections join to secure the upper platform 14 to the lower platform 24. The locations of the supports 34 are also where tie posts will be secured. Note that in the preferred embodiment the lake end of the tower 20 projects to a point 38 slightly beyond one of the supports 34. A cable from the platform to the tower is not shown. It is understood that a suitable cable or rope means may be provided either by a dock manufacturer or by the ultimate user.

Figure 7:
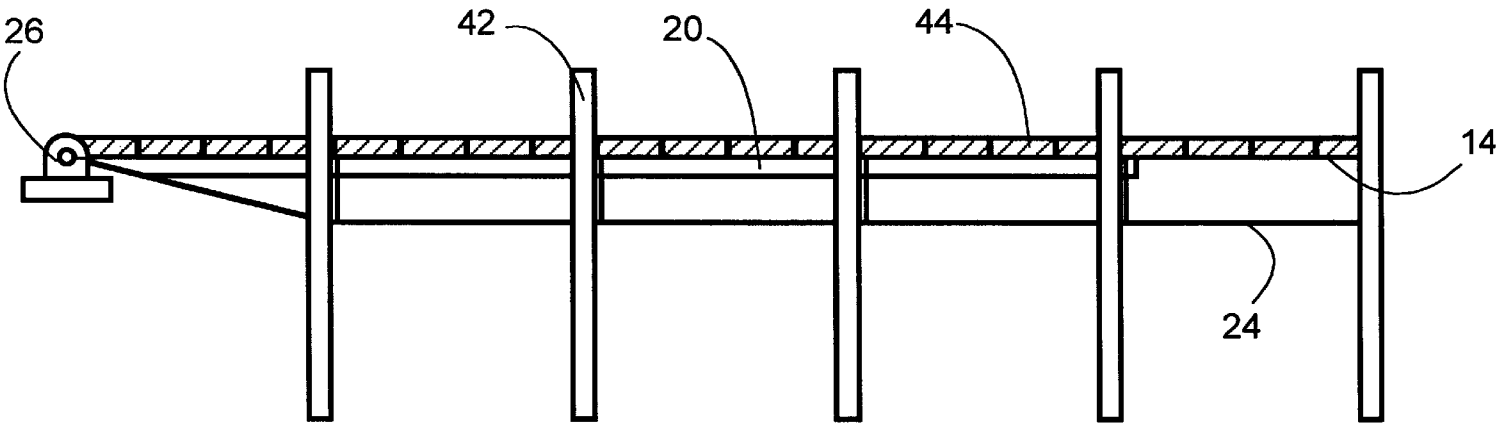
FIG. 7 is a side view of the upper and lower platform structure, tower structure, tie posts, hinge, and decking installed.

FIG. 7 shows a side view of a nearly complete invention in operation as a dock. All the elements of FIG. 6 are shown with several additions. Five sets of tie posts 42 are provided, that are mounted substantially perpendicular to the dock. They are sized so that the platform structure is substantially horizontal over the water when the posts are supporting them from the bottom of a lake or other body of water. The tower structure 20 and upper platform structure 14 are shown hingedly attached to the mounting structure 26. Also, decking 44 is provided for covering the upper platform 14 with the tower structure 20 is disposed within its recess. Preferably decking 44 is provided in removable sections, and is framed by pressure treated two by four inch boards cut to three inches in height and secured to stringers, although other materials can be used. The decking itself is six inch wide pressure treated wood, cedar, or other suitable material.

Although FIG. 7 shows the tower structure 20 and platform structures preferably coaxially hingedly secured to the mounting structure 26, they need not be. They can be staggered or secured to each other in different ways.

Figure 8:
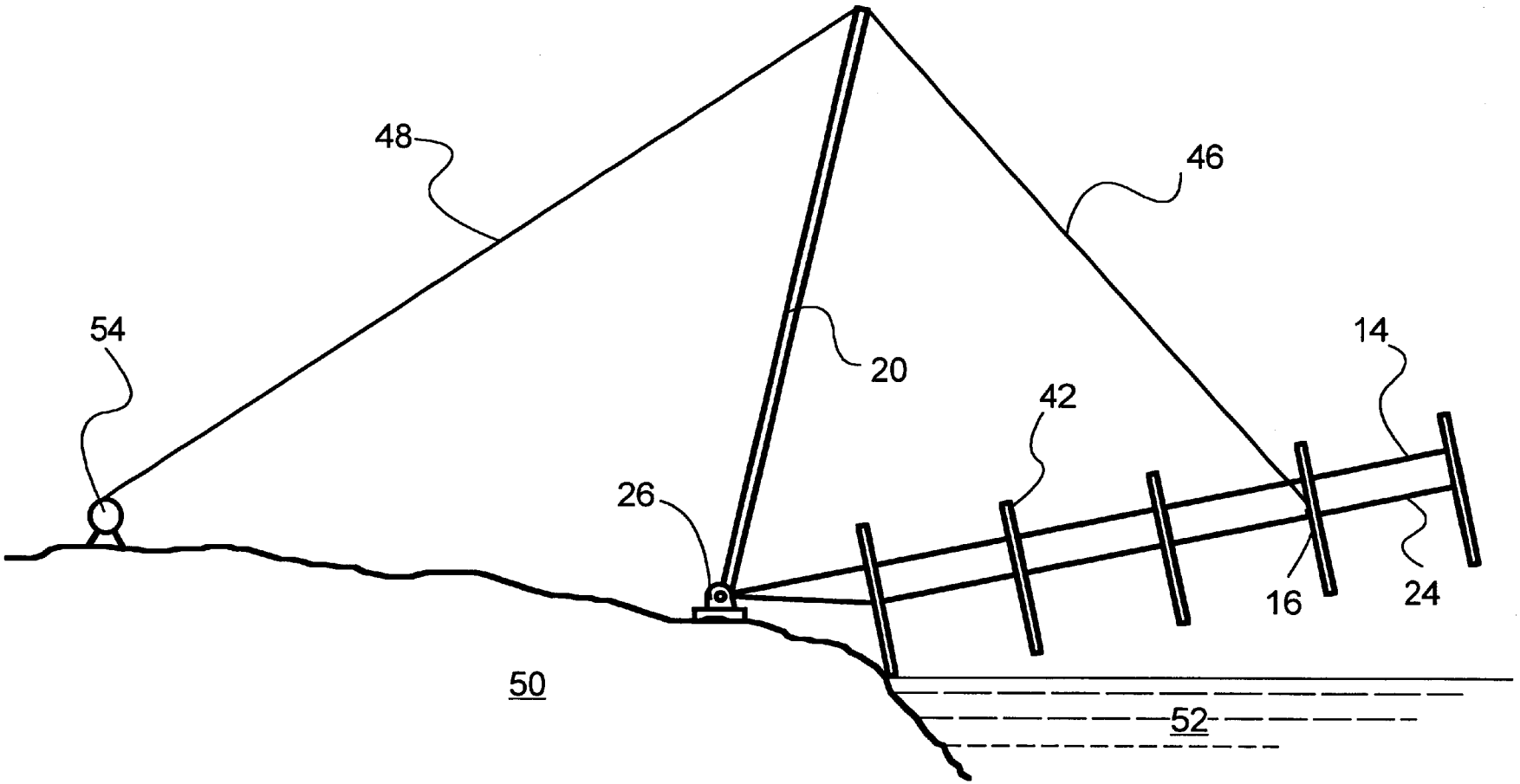
FIG. 8 is a side view of the invention in operation, lifting a dock out of the water.

FIG. 8 shows a side view of the preferred embodiment of the present invention in operation while the dock is being raised. The mounting structure 26 is mounted to the shore 50. At least one cable 46 is secured from the lake end of the tower 20 to the eyes 16 on the lower platform 24. Another cable 48 is secured from the lake end of the tower 20 to a winch 54 or other hoisting device. The cables may be provided as one or more cables. Cable 46 may be split either at the tower 20 or below into a "Y" or "V" so that a cable attaches to eyes 16 on either side of the lower platform 24. The maximum size of cable is about ¼ inch wire rope.

The winch 54 can be hand-operated or electric, preferably with a lifting range of around 2800 to 3200 pounds. The winch 54 can be mounted along the centerline of the dock about three feet off the ground. The preferred minimum distance from the dock is about 21 feet for a 6 foot by 30 foot dock, provided the shore is level and nearly at the level of the water. Otherwise the distance will differ depending upon local terrain. The figure clearly shows the great mechanical advantage that is attained by using this invention to raise the dock away from the water 52.

The 6 foot by 30 foot dock is the most popular version, and the upper deck can be made preferably of five segments, or zones, of about six feet in length. In the preferred embodiment, the dock assembly is manufactured as an integral structure and not in modular sections. Other sizes are 4×18, 4×24, and 6×40 feet. Still other sizes can be made, as long as the 80% ratio is approximately maintained. In all cases, the tower structure 20 is about 80% of the length of the dock.

To manufacture the dock of the preferred embodiment, one uses 6063 aluminum box tubing, having a wall thickness of ⅛ inch. All flat plate used is 6061 aluminum. The bottom run of the lower platform 24 is 24 feet of 2×2 inch aluminum tubing. Place them approximately six feet apart. Weld in place vertical supports 34 that are 13 inches long of 2×2 inch tubing, placed in pairs 9⁄16 inch apart at six foot intervals along the length of the sides. Top that with 30 feet of 2×3 inch box tubing welded in place to start forming the upper platform structure 14. Connect the sides of the lower platform 24 by welding 67 inches long 2×2 inch box tubing crosspieces in place starting at the lake end, aligning each with the pairs of supports 34 in the sides. When placing the crosspieces in the upper platform structure, be sure to align them with the lake side support in each of the pairs as well as the corresponding bottom crosspieces. The top crosspieces must be dropped down three inches to sit flush with the bottom of the side rails in order to allow room for the self-stowing A-frame tower structure 20 to rest within the platform structure. The only exception concerning the crosspieces is that both end pieces are of 2×3 inch box tubing, not 2×2 inch, to match the existing upper 2×3 inch side rail; the shore end crosspiece is set in 16 inches from the end; and the lake end crosspiece is, of course, not dropped down, but set even with the side rails to complete the box shape.

The shore end angle is cut to complete the side of the frame. To attach the 2×3 inch box tubing, make an 11 degree cut to attach the lower end of the frame, which is six feet in from the end of the upper platform. The top angle is determined by marking in place. Cut, then weld in place.

The lower level corner bracing is 2×3 inch box tubing with ends cut at 45 degree angles, the long side of which is 20 inches, welding into place at every corner, 16 in total. Also, at the third and fourth crosspieces, weld in place a ½ by 1 by 5 inch piece of flat bar cut at a 45 degree angle on each side of the dock, attaching to the bottom side rail and the shore side upright. These are to attach the cables for the A-frame at the fourth crosspiece.

The upper platform 14 corner bracing is ¼×3 inch aluminum flat bar cut at 45 degree angles, the long side of which is 16 inches. Starting at the shore end, the bracing is placed on the shore side of the second crosspiece, none on the lake side. The third and fourth crosspieces have bracing on both sides and the fifth has bracing only on the lake side. No bracing is provided at the last crosspiece.

Attach two six foot lengths of 2×3 inch box tubing, evenly spaced across the width of the dock. One end is resting on top of the fifth crosspiece, welded into place, with the other end butted and welded to the end crosspiece.

As was mentioned before, the tower structure 20 is preferably an A-frame, and is preferably about 80% of the length of the dock it is to lift. For example, a 6×30 foot dock would require a 24 foot A-frame. It is also constructed of 2×3 inch aluminum box tubing, and the width of the shore end is such that there is a 1⅝ inch gap on either side between the A-frame and the dock. The lake ends butts together at the end.

Cap the butted tip with ½×3×5 plate, which should overlap ½ inch on each side. Attach a piece of ½×3×3 inch plate with two 7/16 inch holes evenly spaced down its center to the cap, sticking straight out from the end.

Crosspieces are placed every six feet and are set back sufficiently so as not to rest on the crosspieces of the underlying dock. This eliminates the need to grind down the bottom welds, which would weaken them. Ears are attached to the A-frame in the same manner as to the dock itself. Note that the ears have to be placed so as to be square to the matching ears on the dock to which it will be fitted.

Cables may be provided, as mentioned above. A 15 foot piece of cable with ⅜ inch shackles on each end hooks onto each side of the dock at ears on the lower platform. A 17 foot piece, also with ⅜ inch shackles on each end, attaches to the lower of the 7/16 inch holes in the lake end of the A-frame and the other end hooks to the 15 foot cable on the dock, forming a "Y".

While the "Y" configuration works, the preferred configuration is to use two cables of equal length attached in a "V" configuration. Both cables may be attached by a shackle attached to the lake end of the A-frame and the other ends to either side of the platform. The cable length for the "V" configuration would be between about 20 and 24 feet. The length of the cable from the A-frame to the winch is determined at the site, based on the distance from the winch to the dock. This cable is attached to the A-frame at the top 7/16 inch hole at the top of the A-frame.

The procedure for installation of the preferred embodiment follows. The dock and the A-frame 20 must be secured to land 50 by attaching them to the mounting structure 26. If the mounting structure is mounted horizontally to the shore, it is typically at a height of 18 inches above normal lake level, although it can be different to suit the user's preferences. It it is mounted vertically, the height should be about 24 inches. To install, the dock must be put in place in the water 52, using some type of floatation sufficient to aid in attaching the mounting to the mounting structure and subsequent leveling of the dock. The dock and the tower structure are independently bolted to the mounting structure using a total of four bolts and nuts and eight washers. Once the dock is secured to the shore and leveled, the tie posts made of 4×6 inch pressure treated wood, or equivalent, can be installed. The lengths of the tie posts are determined by the depth of the water at their locations, plus sufficient length to achieve a height of a minimum of 36 inches above the deck of the dock. Prior to installing the decking, remove and store the cables for the boating season.

To raise and secure the dock of the preferred embodiment for winter storage, first remove the deck panels. Attach a cable 48 from the winch 54 to the A-frame tower structure 20, and the two cables 46 to form the "Y" shape from the A-frame to the dock. Alternatively, one could form a "V" shape as described above. When cranking the dock up, once the tower structure reaches a 45 degree angle, the cables from the tower structure must be taut. If they are not, adjust the 17 foot section of cable accordingly. Continue cranking the winch 54 until the tower structure is about 90 degrees to the water. The dock should then be about 45 degrees to the water. To prevent lateral motion, guide cables may be attached to either side of the dock at the attachment eyes 16 and secured to the shore 50.

While there have been described what are at present considered to be the preferred embodiments of this invention, it will be obvious to those skilled in the art that various changes and modifications may be made therein without departing from the invention, and it is, therefore, intended to cover all such changes and modifications as fall within the true spirit and scope of the invention.

I claim:

1. A seasonal dock assembly comprising a mounting structure secured to land near a shoreline, a tower structure having a shore end and a lake end opposite the shore end, said lower structure adapted to be hingedly secured at the shore end to the mounting structure, and a platform structure comprising a top surface, a shore end, and a lake end opposite the shore end, said platform structure adapted to be hingedly secured at the shore end to the mounting structure, and said platform structure top surface comprising a recess that is suitably adapted for receiving substantially all of the tower structure within its volume when the tower structure is not in use.

2. The seasonal dock assembly of claim 1 wherein said tower structure and said platform structure are adapted to be coaxially hingedly secured to the mounting structure.

3. The seasonal dock assembly of claim 1 wherein said tower structure is adapted to be hingedly secured to said platform assembly near the platform assembly shore end.

4. The seasonal dock assembly of claim 1 wherein said tower structure comprises an A-frame.

5. The seasonal dock assembly of claim 1 wherein said tower structure comprises a rectangular truss structure.

6. The seasonal dock assembly of claim 1 wherein said tower structure comprises a trapezoidal truss structure.

7. The seasonal dock assembly of claim 1 wherein said tower structure comprises a pole structure.

8. The seasonal dock assembly of claim 1 wherein the length of the tower structure from the shore end to the lake end is about 80% of the length of the platform structure from the shore end to the lake end.

9. The seasonal dock assembly of claim 1 wherein said platform structure comprises a two-level frame suitably adapted to provide sufficient strength, corrosion resistance, and rigidity with a minimum of weight for use as a seasonal dock.

10. The seasonal dock assembly of claim 1 wherein said platform structure and tower structure are made of aluminum box tubing.

11. The seasonal dock assembly of claim 1, further comprising at least two tie posts secured substantially perpendicular to the top surface of the platform structure and suitably adapted so that, when in use, the tie posts support the weight of the platform structure and the top surface is substantially parallel to a water surface.

12. The seasonal dock assembly of claim 1, further comprising a decking structure removably secured to said platform structure top, and surface suitably adapted to enable a user to walk from the platform structure shore end to the platform structure lake end.

13. A seasonal dock assembly comprising a mounting means for securing a dock assembly near a shoreline, a platform structure comprising a top surface, a shore end, and a lake end opposite the shore end, said platform structure adapted to be hingedly secured at the shore end to the mounting means, and a tower structure comprising a shore end and a lake end opposite the shore end, said tower structure adapted to be hingedly secured at the shore end to the mounting means coaxially with the platform structure, and being about 80% the length of the platform structure from the shore end to the lake end, said platform structure having a recess suitably adapted to receive substantially all of the tower structure when not in use, at least two tie posts secured perpendicularly to the top surface of the platform structure and suitably adapted so that, when in use, the tie posts support the weight of the platform structure and the top surface is substantially parallel to a water surface.

at least one dock cable with two ends, the first end secured to the lake end of the tower and the second end secured to platform structure near the recess portion that is nearest the platform lake end, at least one shore cable secured near the lake end of the tower structure, and being suitably sized for reaching the land near the shoreline and suitably adapted for pulling the tower structure and platform structure lake end upward for storage when the dock assembly is not in use, and at least one hoisting means to hoist the dock assembly out of the water by pulling on the shore cable.

14. In a seasonal dock assembly having a mounting structure secured to land near a shoreline; a platform structure having a lake end and a shore end opposite the lake end, the platform structure adapted to be hingedly secured by the shore end to the mounting structure; and a cable attached near the platform structure lake end; the improvement comprising a tower structure having a lake end and a shore end opposite the lake end, the tower structure adapted to be hingedly secured at the shore end to the mounting structure and being about 80% of the length of the platform structure, and a recess in said top platform structure suitably adapted to receive substantially all of the tower structure when the tower structure is not in operation, such that a cable can be attached near the platform structure lake end and tower structure lake end to raise the dock.

15. The dock assembly of claim 14, wherein said tower structure comprises an A-frame.

16. The dock assembly of claim 14, wherein the length of the tower structure from the shore end to the lake end is about 80% of the length of the platform structure from the shore end to the lake end.

17. The dock assembly of claim 14, wherein said platform structure comprises a two-level frame suitably adapted to provide sufficient strength, corrosion resistance, and rigidity with a minimum of weight for use as a seasonal dock.

18. The dock assembly of claim 14, wherein said platform structure and tower structure are made of aluminum box tubing.

19. The seasonal dock assembly of claim 14, further comprising at least two tie posts secured substantially perpendicular to a top surface of the platform structure and suitably adapted so that, when in use, the tie posts support the weight of the platform structure and the top surface is substantially parallel to a water surface.

* * * * *